United States Patent [19]

Richards

[11] 4,122,889

[45] Oct. 31, 1978

[54] COOLING OF CONTINUOUSLY CAST BAR BY HYDRAULIC BAND LIFTING

[75] Inventor: Roy Richards, Carrollton, Ga.

[73] Assignee: Southwire Company, Carrollton, Ga.

[21] Appl. No.: 783,580

[22] Filed: Apr. 1, 1977

[51] Int. Cl.[2] ..... B22D 11/06

[52] U.S. Cl. ..... 164/87; 164/433

[58] Field of Search ..... 164/78, 278, 420, 283 MS, 164/433, 434, 443, 444

[56] References Cited

U.S. PATENT DOCUMENTS

| | | | |
|---|---|---|---|
| 3,261,059 | 7/1966 | Properzi | 164/433 |
| 3,429,363 | 2/1969 | Hazelett et al. | 164/87 |
| 3,575,231 | 4/1971 | Lenaeus | 164/433 X |
| 3,642,055 | 2/1972 | Nighman | 164/87 |
| 3,734,162 | 5/1973 | Chia et al. | 164/87 |
| 3,800,852 | 4/1974 | Properzi | 164/433 |

*Primary Examiner*—Robert L. Spicer, Jr.

*Attorney, Agent, or Firm*—Herbert M. Hanegan; Stanley L. Tate; Robert S. Linne

[57] ABSTRACT

An improved cooling method and apparatus for a continuous casting process of the type wherein the mold is a rotatable casting wheel having a peripheral groove with a portion enclosed by an endless band. The improved cooling of the hot cast metal bar is accomplished by injecting a cooling fluid, under pressure, into the shrinkage gap between the hot continuously cast bar and the band portion of the mold after the bar is partially solidified but before it is removed from the wheel portion of the mold. The hydraulic pressure of the cooling fluid forces the band portion of the mold away from the periphery of the casting wheel so as to allow a quantity of cooling fluid to impinge directly on the hot but solidified band-side surface of the cast bar to directly cool the bar, and also to permit a build-up of fluid pressure in the mold which forces the bar firmly into contact with the walls of the peripheral groove and thus eliminates any shrinkage gap therebetween, thereby increasing the quantity of heat transferred from the hot cast bar.

12 Claims, 6 Drawing Figures

COOLING OF CONTINUOUSLY CAST BAR BY HYDRAULIC BAND LIFTING

BACKGROUND OF THE INVENTION

The continuous casting of metal in a peripheral groove around a rotating casting wheel is well known in the metal foundry art. In the casting of metal in these rotating casting wheels, it has been found that the metal solidifies in three distinct phases as it cools. The first phase begins when the liquid metal is fed into the peripheral groove of the casting wheel and includes that portion of the casting process during which the metal is cooled but is completely liquid within the casting wheel so as to be in complete contact with the casting wheel. The second phase is that portion of the casting process during which the continued cooling of the metal causes an outer crust of solidified metal to form adjacent the casting wheel but during which the metal is still in substantially complete contact with the casting wheel. The third phase is that portion of the casting process beginning generally at or near the point in the solidification of the molten metal at which the continued cooling of the metal and the thickening of the outer crust of solidified metal causes the metal to shrink away from the casting wheel and form an air gap between the metal and the casting wheel. Thus, the third phase includes that portion of the casting process during which the air gap prevents complete contact between the hot metal bar and the casting wheel. The metal bar may not be completely solidified and therefore requires further cooling.

It is this third phase of solidification that is most troublesome in the casting of molten metal in prior art rotating casting wheels since the air gap formed between the cast metal and the casting wheel greatly reduces the rate of heat transfer from the metal to the casting wheel. This is because the heat must be transferred from the cast metal to the casting wheel, in the third phase, principally by radiation heat transfer through the air in the gap between the cast metal and the casting wheel rather than by conduction heat transfer as in the first and second solidification phases, and because less heat can be transferred by radiation heat transfer than by conduction heat transfer at the same relative temperatures.

The low rate of heat transferred during the third phase of solidification in a prior art casting wheel in turn results in limiting the maximum rotational speed of the casting wheel, hence limiting the casting rates that can be achieved. This is because the rotational speed of a prior casting wheel must be slow enough to provide a sufficient dwell time of the metal in the casting wheel during the third phase for the metal to solidify sufficiently in the casting wheel, and because the length of the arcuate casting mold available for the third phase of solidification is limited by structural considerations.

This serious limitation of the maximum casting rate has been recognized in some prior art attempts to increase the cooling of the cast bar during its last phase of solidification. However these attempts are generally not successful in actual practice due to the complex apparatus which often fails to work under the harsh conditions of industrial production. The methods and apparatus disclosed in U.S. Pat. Nos. 3,261,059 and 3,575,231 are exemplary of this prior art.

These patents essentially disclose the use of multiple rollers or wheels for guiding and holding the band away from the casting wheel so that a fluid can be forced entirely around the hot cast bar, totally filling the solidification gap, functioning either as a heat-transfer medium to conduct heat across the gap to the walls of the mold, or as a direct coolant medium to directly cool the peripheral surfaces of the cast bar.

However, not only do these methods fail to achieve the same degree of cooling that can be achieved by direct contact between the cast bar and the walls of the casting groove, but by removing the band from contact with the cast bar and permitting the bar to drop downwardly out of the casting groove so that the fluid can be caused to flow entirely therearound, the bar is no longer firmly supported by the walls of the mold. Consequently, under these conditions, the internal stresses in the still-soft cast bar tend to cause it to deform or even crack, thus adversely affecting the quality of the cast product. Moreover, the use of rollers to deflect the band away from the periphery of the casting wheel induces additional stresses in the band which adversely affects its useful life. Furthermore, in actual practice, these rollers often become inoperable due to an accumulation of metal spilled during the casting operation.

SUMMARY OF THE INVENTION

In view of the foregoing, it should be apparent that a need still exists in the art for an effective method and apparatus for overcoming the problems of solidification shrinkage in the third phase of solidification in continuous casting systems.

Accordingly, it is a primary object of this invention to provide a method and apparatus for substantially eliminating the shrinkage gap between the cast bar and the walls of the peripheral casting groove in the third phase of solidification.

More particularly, it is an object of this invention to provide a method and apparatus for urging the at least partially solidified cast bar into contact with the walls of the casting groove during the third phase of solidification so as to close the shrinkage gap therebetween.

Another object of this invention is to provide a method and apparatus for injecting a fluid into the casting mold between the casting band and the cast bar, and to permit a build-up of fluid pressure therein sufficient to force the bar into contact with the wall surfaces of the peripheral casting groove.

Yet another object of this invention is to provide a method and apparatus for removing the casting band from the periphery of the casting wheel, to permit a fluid to be injected into the interior of the mold, while substantially maintaining support of the cast bar by the walls of the mold.

A further object of this invention is to provide a method and apparatus for injecting fluid into the mold cavity of a continuous casting machine, while avoiding the problems associated with fouling of the rollers used in prior art apparatus to remove the casting band from the periphery of the casting wheel, and to eliminate the stresses induced in the band by the use of such rollers.

Still another object of this invention is to provide a method and apparatus for continuous casting of molten metal, and to improve the heat transfer from the metal in the mold and thus increase the casting rate of the system.

Briefly stated, these and other objects of the invention that may become apparent hereinafter, are accomplished in accordance with the invention by directing high pressure jets of fluid against at least one marginal edge of the casting band along the arcuate length of the mold corresponding to the third casting zone (i.e., wherein the third phase of solidification occurs), said jets serving to lift the band from the periphery of the casting wheel and permit entry of fluid into the mold. The apparatus of the invention includes an arcuate manifold disposed adjacent the periphery of the casting wheel, and having a plurality of nozzles extending therefrom which are adapted to emit high pressure fluid jets against at least one marginal edge of the inner surface of the casting band with a force sufficient to lift the band from the periphery of the wheel and thus permit ingress of the fluid into the interior of the mold. The fluid both functions to directly cool the band-side surface of the cast bar, and additionally vaporizes at the temperature of the casting operation thereby generating an increase in fluid vapor pressure which forces the cast bar firmly into contact with the walls of the casting groove for improved conduction heat transfer therefrom during some, or all, of the third solidification phase. The present apparatus also serves to accelerate solidifying of the metal internally of the casting wheel at a relatively high rate of heat transfer while at the same time supporting the metal during the cooling process in a manner that reduces or eliminates breaks or voids in the cast bar.

The method of the present invention allows the rotational speed of the casting wheel to be increased and also allows an efficient rate of heat transfer to be achieved during some or all of the third solidification phase, an object not easily achieved by prior art cooling methods.

With the above and other objects of the invention that become hereinafter apparent, the nature of the invention may be more clearly understood by reference to the attached drawings, the following detailed description thereof, and the appended claimed subject matter.

DESCRIPTION OF THE PREFERRED EMBODIMENT

Figure 1:
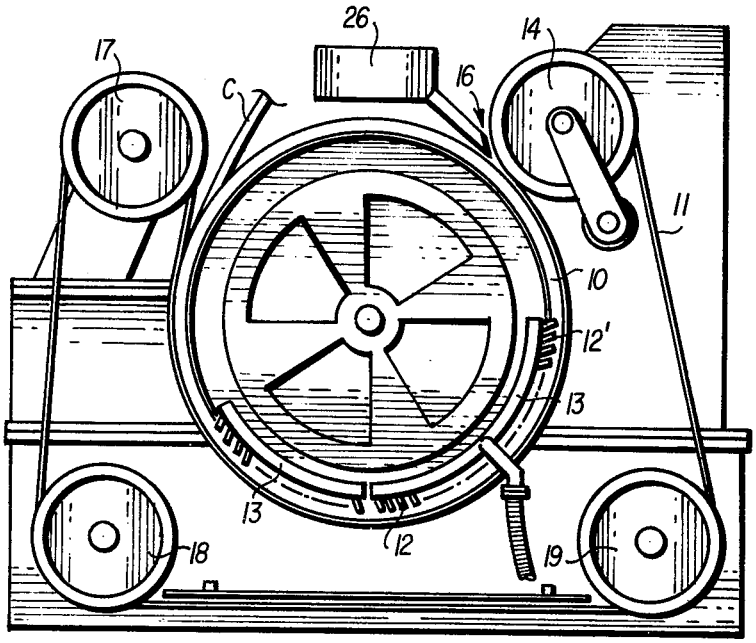
FIG. 1 is a side elevational view of one embodiment of the invention adapted to a typical continuous casting machine.

Referring now in more detail to the drawings, in which like numerals of reference illustrate like parts throughout the several views, FIG. 1 depicts a casting wheel 10 having an endless flexible band 11 positioned against a portion of its periphery by four support wheels 14, 19, 18, and 17. The band support wheel 14 is positioned near a point 16 on the casting wheel 10 where molten metal is fed from a pouring pot 26 into the casting mold M formed by the peripheral groove in wheel 10 and the band 11. Support wheel 17 is positioned at the opposite end of the mold where cast metal C is discharged after being sufficiently solidified. One or more other support wheels, such as 18 and 19, guide the endless band back to its starting point while maintaining a sufficient tension in the band so that it sealingly engages the casting wheel throughout the portion containing the cast metal.

Not shown in FIG. 1 are conventional cooling manifolds associated with the casting apparatus which include spray assemblies positioned to cool the interior of the wheel 10 and the exterior of the band 11. These conventional cooling manifolds are well known in the art and disclosed in detail in U.S. Pat. No. 3,279,000.

Figure 4:
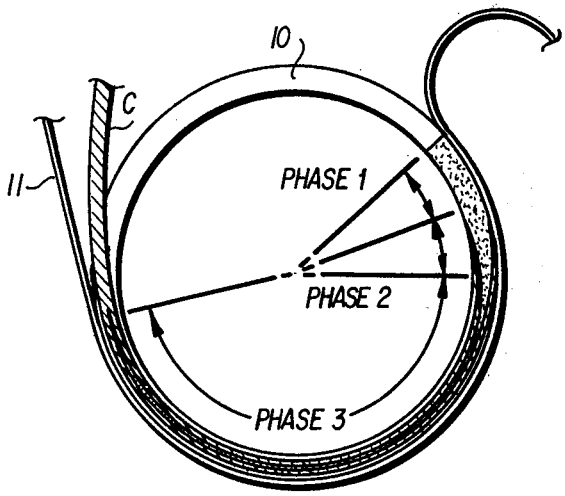
FIG. 4 is a schematic representation of the three phases of solidification in the typical casting machine of FIG. 1.

As seen in FIG. 4, the molten metal undergoes three phases of solidification in the casting wheel 10. As explained above, the metal in phase one is completely molten and fills the casting mold completely and is in contact with the wall surfaces thereof. In phase two the metal forms an outer solid skin, but still includes a molten metal core. In phase three the metal continues to solidify as it is cooled and beings to shrink away from the walls of the casting mold. This phenomenon is illustrated most clearly in FIG. 2 wherein there is illustrated a gap G existing between the at least partially solidified cast bar and the walls of the arcuate mold, including both the walls of the peripheral groove in the casting wheel 10 and the inner surface of the band 11.

In accordance with the present invention, the casting apparatus illustrated in FIG. 1 is provided with one or more cooling manifolds 13 having a plurality of spray nozzles 12 extending therefrom. The nozzles 12 are adapted to emit high pressure jets of fluid against a marginal edge of the inner surface of the casting band 11 as seen most clearly in FIG. 3 with a force sufficient to lift the band 11 away from the periphery of the casting wheel 10 and to permit ingress of the fluid into the interior of the mold.

The cooling manifold 13 is positioned along the arcuate length of the mold such that the stream of cooling liquid from the first spray nozzle 12' impinges at or after a point on the band 11 which corresponds to the end of the second phase of solidification of the cast bar. This point is illustrated in FIG. 4 as being at about the three o'clock position on the mold; however, the exact location of this point will, of course, vary with the casting rate. At fast casting rates, or at slow cooling rates, the point would occur much later along the arcuate length of the mold. Since it is desirable that the thickness of the soldified crust be about at least ¼ inch at the point of the first water impingement, it is advantageous to provide a means (not shown) for selecting which of the nozzles 12 will be the first operable spray nozzle 12'. Such means could be either valves between the nozzles and the manifold or simply means for moving the entire manifold 13 along the arcuate path of the mold.

It is not necessary that the first nozzle 12' be exactly at the point of the end of the second phase of solidification since only a small decrease in the cooling rate is experienced when the point of impingement is later, i.e., at the beginning of phase three of soldification. It is, however, absolutely necessary to avoid spraying water into the mold during the first phase of solidification where the cast metal is still molten, inasmuch as this might lead to violent explosions.

Figure 3:
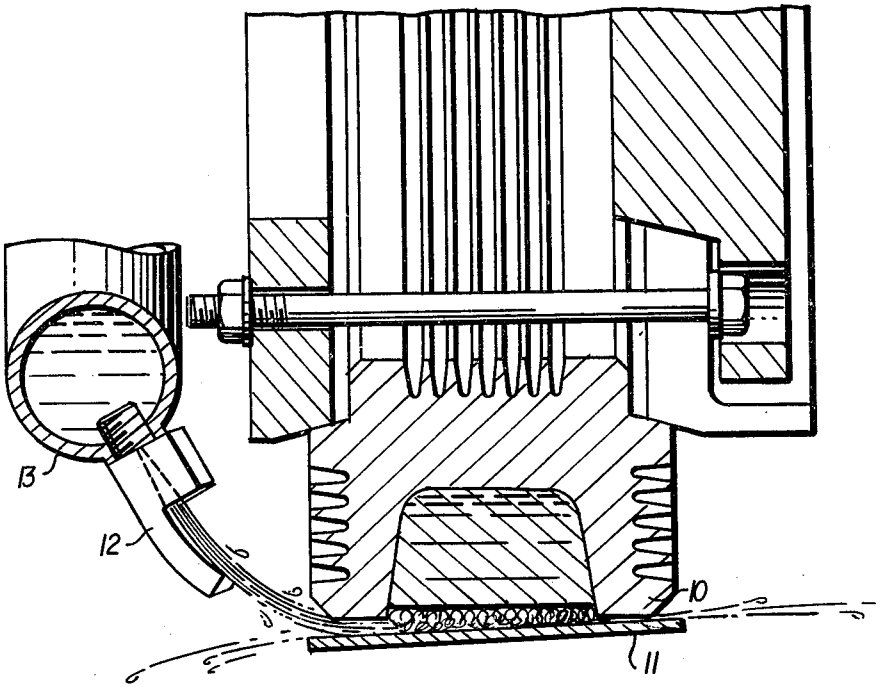
FIG. 3 is an enlarged cross sectional view taken near the bottom of casting wheel of FIG. 1 showing the present invention; eliminating the shrinkage gap and cooling the cast bar directly.
Figure 2:
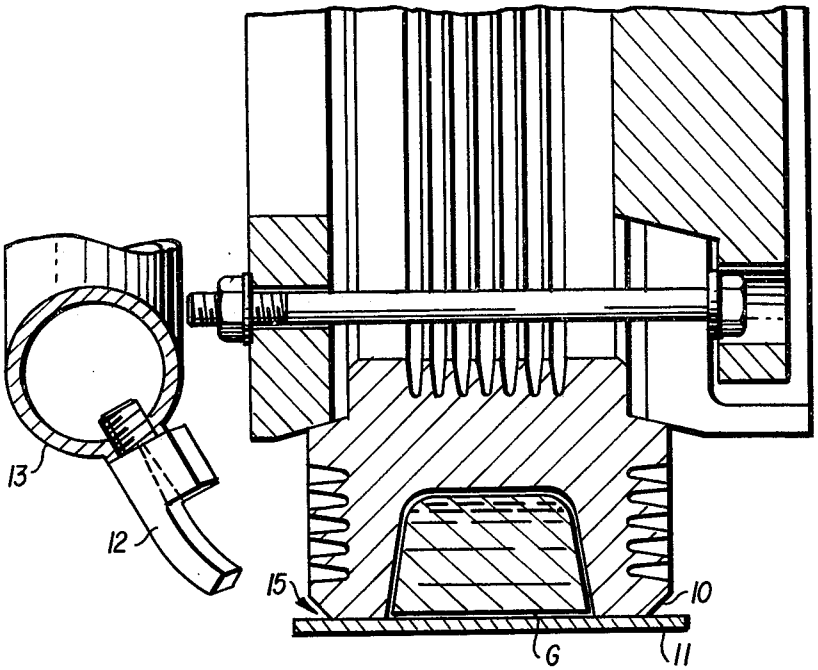
FIG. 2 is an enlarged cross sectional view taken near the bottom of the casting wheel of FIG. 1 showing the usual shrinkage gap characteristic of prior art systems.

As seen most clearly in FIGS. 2 and 3, the peripheral edges of the casting wheel 10 are preferably chamfered so that a wedge-shaped interface area 15 extends peripherally about the arcuate mold between the band 11 and the peripheral edge of the casting wheel 10. During the third stage of solidification, high pressure jets of coolant are emitted from the nozzles 12 toward the wedge-shaped interface 15 and of a magnitude sufficient to lift the band 11 away from the periphery of the casting wheel 10. If the fluid jets are directed only at one edge or marginal zone of the band 11, in accordance with the preferred embodiment of the invention, rather than at both edges of the band 11, the band 11 will become skewed or inclined with respect to the periphery of the wheel 10 as seen in FIG. 3. Thus, the fluid jets will deflect off of the band 11 and readily enter the interior of the mold; however, at the opposite side of the mold the band 11 will be urged more closely into sealing engagement with the periphery of the wheel 10, thus inhibiting egress of the fluid therefrom. It should be apparent, therefore, that the fluid will build-up in the interior of the mold, and vaporize therein under the heat of the casting operation. Consequently, this fluid pressure will exert a force on the bandside surface of the cast bar and force the bar into contact with the wall surfaces of the peripheral groove. It should be apparent that the coolant fluid, e.g., water, both directly cools the band-side surface of the cast bar, and generates steam which forces the bar into contact with the wall surfaces of the casting groove, thus increasing the conduction heat transer therebetween.

In contra-distinction to prior art systems, wherein the cast bar is permitted to fall downwardly out of the casting groove so that the cooling fluid is permitted to entirely engulf the bar, the cast bar in the present invention is not permitted to fall downwardly out of the mold but rather is pressed firmly into the mold thereby providing firm support for the same and preventing cracking and deformation of the bar.

Figure 6:
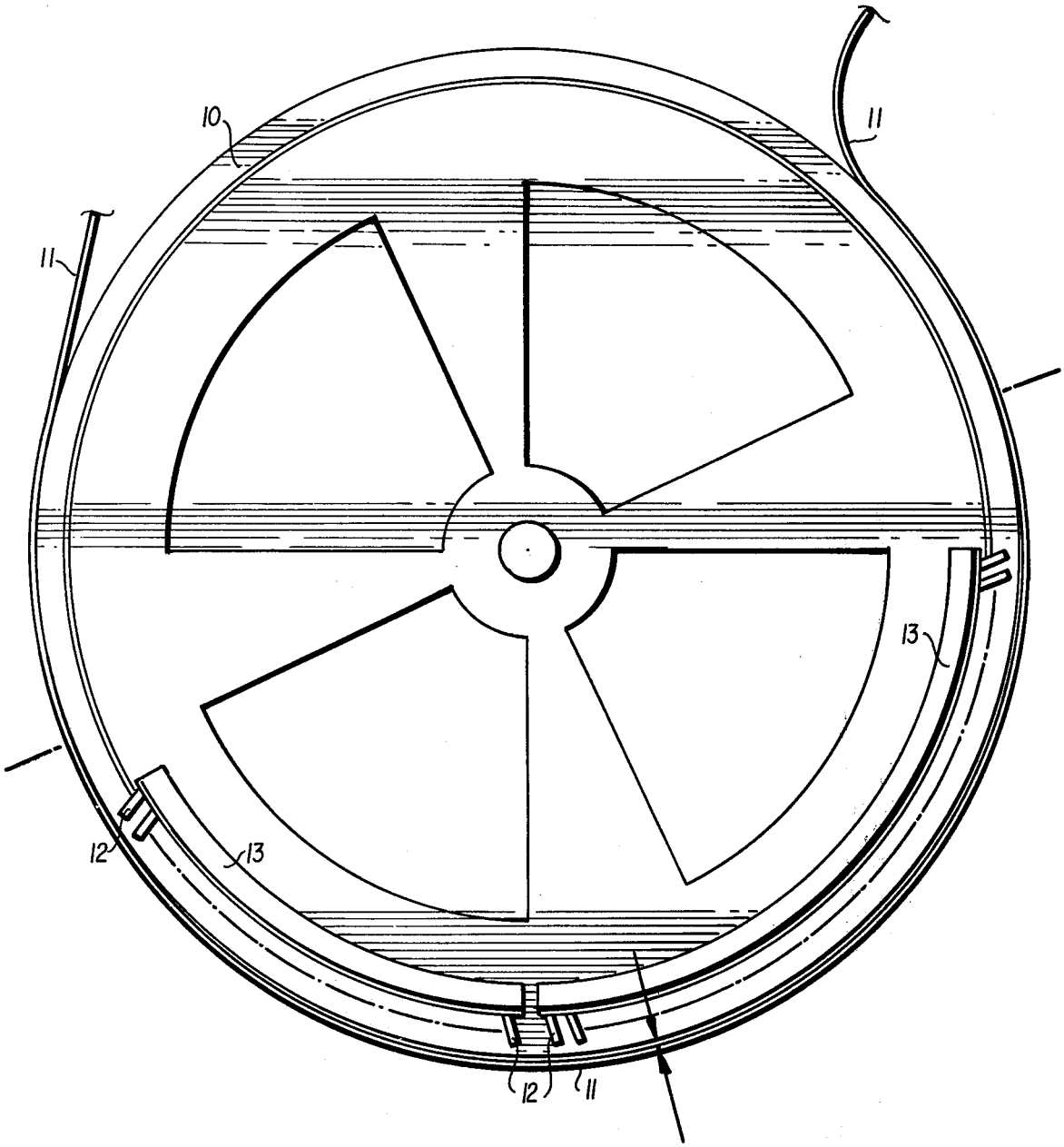
FIG. 6 is an enlarged side elevation view of the casting wheel of FIG. 1, and depicts the casting band having been lifted from the periphery of the casting wheel under the force of the fluid jets, along a given segment of the arcuate mold, but wherein the band is in sealing contact with the peripheral surface of the casting wheel along substantial segments extending inwardly from the inlet and outlet, respectively, of the arcuate mold.

Furthermore, as seen most clearly in FIG. 6, the fluid jets emitted from the nozzles 12 operate only on a given segment of the band 11 along a portion of the arcuate mold. Thus, the band 11 is maintained in sealing contact with the periphery of the wheel 11 along substantial arcuate segments extending inwardly from both the inlet and outlet of the mold. Because of this construction and arrangement, the cast bar is further firmly supported in the casting mold.

Figure 5:
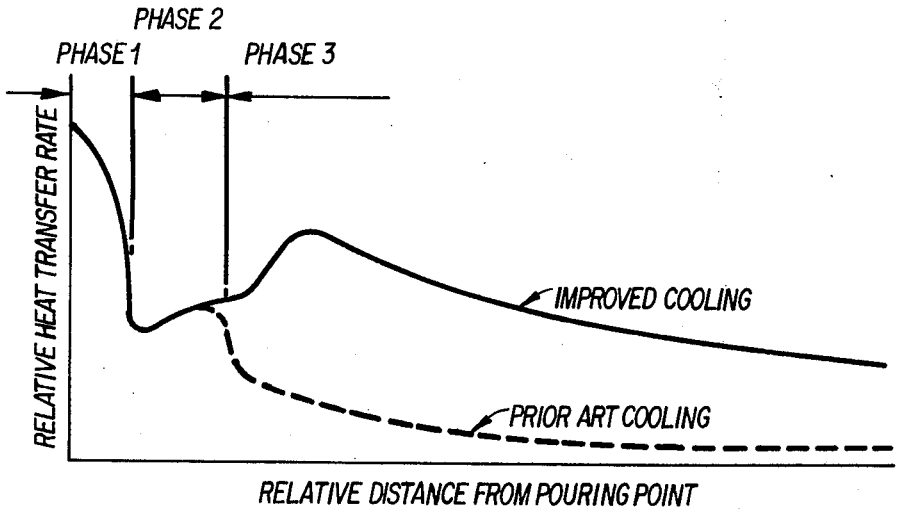
FIG. 5 is a graph comparing the relative cooling rates during solidification when practicing the present invention as compared to the cooling rate in the prior art casting methods.

The relative cooling rate improvement due to this invention is diagrammed in FIG. 5 which shows the heat transfer rates during the three phases of solidification of a typical cast metal. In this invention and in the prior art methods of cooling, the heat transfer rates during phase 1 and 2 are essentially the same. However, during phase 3, the prior art methods experience a drastic reduction of heat transfer due to the shrinkage gap formation. With this invention the heat transfer rate during phase three is much improved due to the absence of any significant shrinkage gap. Therefore, less dwell time for the metal in the third phase of solidification is needed to fully solidify the cast metal. This allows an increase in the overall casting rate since the rotational speed of the wheel can be increased as the required dwell time is decreased.

After the metal passes through this zone of increased cooling the band 11 resumes contact with the casting wheel 10 and the bar is extracted from the casting wheel in the usual manner to be passed on to subsequent processing equipment such as a rolling mill, for example.

OPERATION

In operation of the apparatus and in practicing the method of this invention, the casting apparatus is started in the usual manner by rotating the casting wheel 10 with a conventional power means, not shown, and the band 11 is positioned against the casting wheel 10, to form the mold, by presser wheel 14. The pouring pot 26 directs molten metal into the mold and the metal begins to solidify as a result of cooling of the wheel and band by conventional interior and exterior spray assemblies, not shown. As the molten metal moves with the mold, it is cooled sufficiently during its first solidification phase to start partial solidification of the metal. This forms a crust of metal adjacent the sides of the mold while the metal in the center of the mold is still liquid and unsolidified. This crust continues to thicken during the second solidification phase and the rotational speed of the casting wheel is such that by the time the metal has reached the end of phase two, the crust enclosing the molten center is sufficiently thick to support the molten metal without collapsing. Depending on the rotational speed of casting wheel 10, cooling manifolds 13 are positioned, as explained previously, so that water is sprayed into the wheel-band interface thereby lifting the band 11 from contact with the wheel 10 and exposing the semi-solid cast bar to the cooling water. Since the cooling manifolds 13 are flexibly connected to the main coolant supply, their positions can be varied depending upon the particular point on the casting wheel at which the third phase of solidification begins for each particular casting rate. The third phase of solidification begins when the crust of solidified metal becomes sufficiently thick so that the cast bar shrinks away from the mold walls. The gap G formed between the mold and the solidified metal crust C greatly reduces the rate at which heat is transferred from the bar to the mold during the third phase. This is shown by the diagram of FIG. 5 wherein the rate of heat transfer of the mold during solidification of the metal in a prior art system is indicated by the dashed line. The greatly reduced cooling rate during the third phase of solidification, characteristic of prior art cooling systems, limits the maximum rotational speed of the casting wheel so that speed which insures that sufficient solidification of cast bar C takes place while the bar is within the peripheral groove of the casting wheel. Again referring to FIG. 5, it can be seen that the cooling rate obtained when practicing the improved cooling method and apparatus of this invention is much greater, as illustrated by the solid line, during the third phase of solidification due to the elimination of the gap between the wheel 10 and the hot cast bar C. Thus it should now be understood that the invention requires the operation of the casting machine at a rotational speed which will result in the metal passing into this area of increased cooling at the beginning of, or early in, the third solidification phase. It will also be understood that this requirement depends upon the exact placement of the cooling manifold 13 but in any event provides greater casting rates than were possible with prior art cooling methods. It will also be noted that the molten metal is poured into the arcuate mold at a high level on one side of the casting wheel 10 and is completely solidified before the molten core reaches a corresponding level on the opposite side of the casting wheel. Thus the molten core is always maintained under a high hydrostatic pressure, which is effectice to reduce the frequency of voids or cavities appearing in the cast bar.

Although a specific embodiment of the invention has been disclosed herein in illustrating the invention, it is to be understood that the inventive concept is not limited thereto since it may be embodied in the other arrangements or devices in which coolant fluid is used to force the bar firmly into the wheel, without departing from the scope of this invention as set forth in the appended claims. However, the apparatus disclosed herein is a particularly suitable arrangement.

I claim:

1. In a wheel-band type continuous casting machine for casting molten metal into continuous cast bar, comprising a rotatable casting wheel having a groove formed in the periphery thereof which is closed over a portion of its length by an endless flexible metal band to form an arcuate mold having an inlet and an outlet, means for pouring molten metal into the inlet of the mold, means for cooling the molten metal in the mold to solidify the same in successive stages into cast bar, means for extracting the cast bar from the outlet of the mold, and wherein along a portion of the length of said arcuate mold the at least partially solidified cast bar shrinks away from the walls of the mold thus forming a gap therebetween;

the improvement comprising means disposed in the region of said portion of the length of said arcuate mold for urging the at least partially solidified cast bar radially inwardly into contact with the walls of the casting groove so as to substantially close the gap therein and promote conduction heat transfer therebetween, wherein said urging means includes means for removing the band from a portion of the periphery of the casting wheel along a given segment of the arcuate length thereof disposed between the inlet and outlet of said mold, while maintaining said band in sealing contact with the periphery of the casting wheel over a substantial segment of the arcuate mold extending from each of the inlet and outlet, respectively, toward said given segment, and means for spraying a fluid jet into said arcuate mold in the region of said given segment between the cast bar and said band, said fluid jet exerting a pressure against the cast bar to force the same into contact with the walls of the casting groove.

2. The combination of claim 1, wherein the surface of the cast bar confronting said flexible band is the band-side surface, and wherein said fluid jet exerts a radial force directly against said band-side surface of the at least partially solidified cast bar.

3. The combination of claim 2, wherein said fluid is vaporizable at the temperature prevailing in said mold during the casting operation, means for permitting the vapor pressure of said fluid to build-up between the band and the band-side surface of the cast bar, and wherein said vapor pressure further urges the cast bar into contact with the walls of the casting groove.

4. The combination of claim 1, wherein said spraying means includes high pressure nozzle means disposed adjacent said casting wheel and positioned to direct at least one high pressure fluid jet against a marginal edge of the inner face of the bandwith an outwardly directed radial component, said radial component being of a magnitude sufficient to remove said band from the periphery of said wheel and permit ingress of said at least one fluid jet into said arcuate mold.

5. The combination of claim 4, wherein said spraying means includes arcuate manifold means extending adjacent said portion of the length of said arcuate mold where the at least partially solidified cast bar shrinks away from the walls of the mold, and said nozzle means include a plurality of nozzles extending from said manifold means and adapted to direct a plurality of high pressure fluid jets against the inner face of said band.

6. In a wheel-band type continuous casting machine for casting molten metal into continuous cast bar, comprising a rotatable casting wheel having a groove formed in the periphery thereof which is closed over a portion of its length by an endless flexible metal band to form an arcuate mold, said band having inner and outer faces, means for urging the inner face of said band into sealing contact with the periphery of said casting wheel along the length thereof forming said arcuate mold, and means for lifting said band from the periphery of said casting wheel along a segment thereof forming a portion of said arcuate mold in order to permit ingress of a cooling fluid into said mold for direct contact with an at least partially solidified cast bar therein;

the improvement wherein said lifting means solely consists of nozzle means disposed adjacent said casting wheel for directing at least one high pressure fluid jet against a marginal edge of the inner face of said band and of a magnitude sufficient to overcome the force of said means urging said band into sealing contact with the periphery of said casting wheel, said at least one high pressure fluid jet being a cooling fluid, and said nozzle means being positioned and directed relative to said band for enabling said at least one high pressure fluid jet to at least partially deflect off of the inner face of said band into said arcuate mold and exert a pressure against the cast bar to force the same into contact with the walls of the casting groove.

7. The combination of claim 6, wherein at least one edge of the periphery of said casting wheel is chamfered, and said at least one high pressure fluid jet is directed toward the interface of said band and the chamfered edge of said casting wheel.

8. A method of continuously casting molten metal into continuous cast bar, comprising the steps of:

(a) pouring molten metal into an arcuate mold having an inlet and an outlet and which is defined by a groove formed in the periphery of a rotatable casting wheel which is closed over a portion of its length by a movable flexible band;

(b) cooling the molten metal in the mold to solidify the same in successive stages into cast bar, the at least partially solidified cast bar shrinking away from the walls of the mold during the final stage of solidification to form a gap therebetween;

(c) removing the band from a portion of the periphery of the casting wheel along a given segment of the arcuate length thereof disposed between the inlet and outlet of the mold, while maintaining the band in sealing contact with the periphery of the casting wheel over a substantial segment of the mold extending from each of the inlet and outlet, respectively, toward the given segment; and (d) spraying a fluid jet into the arcuate mold in the region of the given segment between the cast bar and the band in order to exert a pressure against the cast bar to force the same into contact with the walls of the casting groove during the final stage of solidification thereby closing the gap therein and promoting conduction heat transfer therebetween.

9. The method of claim 8, wherein said fluid is a vaporizable fluid at the temperature of the casting operation, and further including the steps of:

(d) vaporizing said fluid in the mold; and (e) restricting the egress of said fluid from the mold to thereby permit the vapor pressure to increase to a level at which the at least partially solidified cast bar is forced into contact with the walls of the casting groove.

10. The method of claim 8 further including the steps of:

removing the casting band from the periphery of the casting wheel by directing a high pressure fluid jet thereagainst;

(f) emitting said fluid jet from at least one nozzle disposed adjacent the casting wheel; and (g) deflecting said high pressure jet off of the casting band into the mold.

11. The method of claim 10, wherein the step of deflecting the high pressure jet off of the casting band also functions to lift the casting band from the periphery of the casting wheel.

12. In a continuous metal casting process of the type wherein molten metal is poured into an arcuate mold defined by a peripheral groove in a rotatable casting wheel and an endless band extending about a portion of said peripheral groove, the improvement comprising the steps of:

(a) flowing molten metal into said mold of the rotating casting wheel, (b) cooling said molten metal within said mold as the metal passes around said rotating casting wheel until the metal has at least partially solidified, (c) continuing to pass the partially solidified metal around said casting wheel so that said metal is continuously supported by the peripheral groove of the casting wheel and by the endless band, (d) removing the band from a portion of the periphery of the casting wheel along a given segment of the arcuate length thereof disposed between the inlet and outlet of the mold, while maintaining the band in sealing contact with the periphery of the casting wheel over a substantial segment of the mold extending from each of the inlet and outlet, respectively, toward the given segment; and (e) spraying a fluid jet into the arcuate mold in the region of the given segment between the cast bar and the band in order to exert a pressure against the cast bar to force the same into contact with the walls of the casting groove during the final stage of solidification thereby closing the gap therein and promoting conduction heat transfer therebetween, (f) continuing to spray said fluid between the band and the surface of the partially solidified metal, thereby cooling said metal, until said metal is substantially solidified while supporting said metal within the groove of the casting wheel, and (g) removing the metal from the peripheral groove of the rotating casting wheel after the metal has become substantially solidified.

* * * * *